US006396456B1

(12) United States Patent
Chiang et al.

(10) Patent No.: US 6,396,456 B1
(45) Date of Patent: May 28, 2002

(54) STACKED DIPOLE ANTENNA FOR USE IN WIRELESS COMMUNICATIONS SYSTEMS

(75) Inventors: Bing Chiang, Melbourne; Kenneth M. Gainey, Satellite Beach; James A. Proctor, Jr., Indialantic, all of FL (US)

(73) Assignee: Tantivy Communications, Inc., Melbourne, FL (US)

( * ) Notice: Subject to any disclaimer, the term of this patent is extended or adjusted under 35 U.S.C. 154(b) by 0 days.

(21) Appl. No.: 09/773,277

(22) Filed: Jan. 31, 2001

(51) Int. Cl.[7] ..... H01Q 9/28

(52) U.S. Cl. ..... 343/795; 343/700 MS; 343/846

(58) Field of Search ..... 343/700 MS, 702, 343/792, 793, 794, 795, 829, 846, 853; H01R 9/28

(56) References Cited

U.S. PATENT DOCUMENTS

| | | | | |
|---|---|---|---|---|
| 4,125,839 | A | 11/1978 | Kaloi | 343/700 |
| 4,414,550 | A * | 11/1983 | Tresselt | 343/700 MS |
| 4,471,493 | A | 9/1984 | Schober | 455/90 |
| 4,475,111 | A | 10/1984 | Gittinger et al. | 343/881 |
| 4,608,572 | A | 8/1986 | Blakney et al. | 343/792.5 |
| 4,827,271 | A | 5/1989 | Berneking et al. | 343/700 |
| 4,853,704 | A | 8/1989 | Diaz et al. | 343/767 |
| 5,010,349 | A | 4/1991 | Mizuno et al. | 343/700 |
| 5,121,127 | A | 6/1992 | Toriyama | 343/700 |
| 5,210,542 | A | 5/1993 | Pett et al. | 343/700 |
| 5,216,430 | A | 6/1993 | Rahm et al. | 343/700 |
| 5,245,349 | A | 9/1993 | Harada | 343/700 |
| 5,400,040 | A | 3/1995 | Lane et al. | 343/700 |
| 5,434,575 | A | 7/1995 | Jelinek et al. | 342/365 |
| 5,442,366 | A | 8/1995 | Sanford | 343/700 |
| 5,467,095 | A * | 11/1995 | Rodal et al. | 343/700 MS |
| 5,519,408 | A | 5/1996 | Schnetzer | 343/767 |
| 5,661,493 | A * | 8/1997 | Uher et al. | 343/700 MS |
| 5,905,465 | A * | 5/1999 | Olson et al. | 343/700 MS |
| 5,990,836 | A | 11/1999 | Bhattacharyya | 343/700 |
| 5,995,048 | A | 11/1999 | Smithgall et al. | 343/700 |
| 6,094,177 | A | 7/2000 | Yamamoto | 343/806 |
| 6,100,855 | A | 8/2000 | Vinson et al. | 343/846 |
| 6,111,552 | A | 8/2000 | Gasser | 343/873 |
| 6,114,996 | A | 9/2000 | Nghiem | 343/700 |
| 6,121,932 | A | 9/2000 | McCoy et al. | 343/700 |
| 6,140,965 | A | 10/2000 | Van Hoozen | 343/700 |
| 6,335,703 | B1 * | 1/2002 | Chang et al. | 343/700 MS |

* cited by examiner

*Primary Examiner*—Tho G. Phan
(74) *Attorney, Agent, or Firm*—Hamilton, Brook, Smith & Reynolds, P.C.

(57) ABSTRACT

A dipole antenna for use with a mobile subscriber unit in a wireless communications system. The antenna is fabricated with printed circuit board (PCB) photo-etching techniques for precise control of the printed structure to mass produce antenna elements with repeatable features. The antenna includes a planar substrate made of dielectric material. A conductive planar element layered on one side of the substrate, and a conductive planar ground patch is located on the other side of the substrate. The conductive planar element is located in an upper region of the substrate, while the location of the planar ground patch is offset from the conductive planar element in a lower region of the substrate. A feed strip is connected to the conductive planar element, extends from the element to a bottom edge of the substrate, and terminates at a bottom feed point. The conductive planar ground patch includes two portions. One portion extends from the midsection of the other portion to the bottom edge of the substrate and provides a connection point for coupling the conductive planar ground patch to a ground plane which is aligned orthonormally to the substrate. Capacitive coupling between the conductive planar element and the conductive planar ground patch creates a junction which provides an upper dipole feed point in a mid-region of the substrate such that the conductive planar element acts as a first element of an unbalanced dipole antenna and the conductive planar ground patch acts as a second element of the unbalanced dipole antenna. The unbalanced dipole antenna forms a beam which may be positionally directed along a horizon that is substantially parallel to the ground plane.

27 Claims, 5 Drawing Sheets

STACKED DIPOLE ANTENNA FOR USE IN WIRELESS COMMUNICATIONS SYSTEMS

BACKGROUND OF THE INVENTION

Code Division Multiple Access (CDMA) communication systems may be used to provide wireless communication between a base station and one or more subscriber units. The base station is typically a computer controlled set of switching transceivers that are interconnected to a land-based public switched telephone network (PSTN). The base station includes an antenna apparatus for sending forward link radio frequency signals to the mobile subscriber units: The base station antenna is also responsible for receiving reverse link radio frequency signals transmitted from each mobile unit. Each mobile subscriber unit also contains an antenna apparatus for the reception of the forward link signals and for transmission of the reverse link signals. A typical mobile subscriber unit is a digital cellular telephone handset or a personal computer coupled to a wireless cellular modem.

The most common type of antenna used to transmit and receive signals at a mobile subscriber unit is an omnidirectional monopole antenna. This type of antenna consists of a single wire or antenna element that is coupled to a transceiver within the subscriber unit. The transceiver receives reverse link signals to be transmitted from circuitry within the subscriber unit and modulates the signals onto the antenna element at a specified frequency assigned to that subscriber unit. Forward link signals received by the antenna element at a specified frequency are demodulated by the transceiver and supplied to processing circuitry within the subscriber unit. In CDMA cellular systems, multiple mobile subscriber units may transmit and receive signals on the same frequency and use coding algorithms to detect signaling information intended for individual subscriber units on a per unit basis.

The transmitted signal sent from a monopole antenna is omnidirectional in nature. That is, the signal is sent with the same signal strength in all directions in a generally horizontal plane. Reception of signals with a monopole antenna element is likewise omnidirectional. A monopole antenna does not differentiate in its ability to detect a signal on one direction versus detection of the same or a different signal coming from another direction.

SUMMARY OF THE INVENTION

Various problems are inherent in prior art antennas used on mobile subscriber units in wireless communications systems. Typically, an antenna array with scanning capabilities consists of a number of antenna elements located on top of a ground plane. For the subscriber unit to satisfy portability requirements, the ground plane must be physically small. For example, in cellular communication applications, the ground plane is typically smaller than the wavelength of the transmitted and received signals. Because of the interaction between the small ground plane and the antenna elements, which are typically monopole elements, the peak strength of the beam formed by the array is elevated above the horizon, for example, by about 30°, even though the beam itself is directed along the horizon. Correspondingly the strength of the beam along the horizon is about 3 db less than the peak strength. Generally, the subscriber units are located at large distances from the base stations such that the angle of incidence between the subscriber unit and the base station is approximately zero. The ground plane would have to be significantly larger than the wavelength of the transmitted/received signals to be able to bring the peak beam down towards the horizon. For example, in an 800 Mhz system, the ground plane would have to be significantly larger than 14 inches in diameter, and in a PCS system operating at about 1900 Mhz, the ground plane would have to be significantly larger than about 6.5 inches in diameter. Ground planes with such large sizes would prohibit using the subscriber unit as a portable device. It is desirable, therefore, to direct the peak strength of the beam along the horizon with antenna elements mounted on a small ground plane so that the subscriber unit is mobile. Further, it is desirable to produce antenna elements with these beam directing features using low-cost mass production techniques.

The present invention greatly reduces problems encountered by the aforementioned prior art antenna systems. The present invention provides an inexpensive antenna for use with a mobile subscriber unit in a wireless same frequency network communications system, such as CDMA cellular communication networks. The antenna is isolated from the ground with a choke or narrow microstrip. The antenna is fabricated with printed circuit board (PCB) photo-etching techniques for precise control of the printed structure to mass produce antenna elements having repeatable features.

In one aspect of the invention, the dipole antenna includes a planar substrate made of dielectric material. A conductive planar element is layered on one side of the substrate, and a conductive planar ground patch is layered on the other side of the substrate. The conductive planar element is located in an upper region of the substrate, while the location of the planar ground patch is offset from the conductive planar element in a lower region of the substrate, that is, the conductive planar element is stacked above the conductive planar ground patch. A feed strip is connected to the conductive planar element, extends from the element to a bottom edge of the substrate, and terminates at a bottom feed point.

The conductive planar ground patch includes two portions. One portion extends from the midsection of the second portion to the bottom edge of the substrate and provides a connection point for coupling the conductive planar ground patch to a ground plane which is aligned orthonormally to the substrate.

Capacitive coupling between the conductive planar element and the conductive planar ground patch creates a junction which provides an upper dipole feed point in a mid-region of the substrate such that the conductive planar element acts as a first element of an unbalanced dipole antenna and the conductive planar ground patch acts as a second element of the unbalanced dipole antenna. The unbalanced dipole antenna forms a beam which may be positionally directed along a horizon that is substantially parallel to the ground plane.

Embodiments of this aspect can include one or more of the following features. The conductive planar element includes a base that is aligned parallel to a top edge of the substrate. The planar element also has a middle arm connected to a midsection of the base, and two outer arms connected to either end of the base. Each of the three arms are aligned perpendicularly to the base and extend towards the top edge of the substrate. The feed strip is connected to the midsection of the base and has an enlarged section. This size and location of this enlarged section can be varied to match the impedance of the dipole antenna with the feed impedance.

One portion of the conductive planar ground patch has a top strip aligned parallel to the bottom edge of the substrate. Located on either end of the strip is an arm which extends downward towards the bottom edge. The other portion of the conductive ground patch is a middle strip aligned perpendicularly to the bottom edge of the substrate. The downward extending outer arms can flare away from this middle strip to prevent coupling between the resonating outer arms and the middle strip which is connected to the ground plane. The lengths of these outer arms are approximately equal in length to a quarter wavelength of the transmitted and received signals.

The lengths of these outer arms as well as that of the arms of the conductive planar element can be varied to change the transmission frequency of the dipole antenna. If the lengths of the arms are approximately equal to one another, the dipole antenna transmits over a narrow bandwidth. For example, the dipole antenna is capable of operating with a bandwidth of about 10%. Alternatively, the lengths of the arms can be at different lengths to widen the bandwidth of the dipole antenna, for example, to a bandwidth of about 15%. Or the lengths can be varied so that the antenna operates at two or more frequencies.

The dielectric substrate can be made from, for example, common PCB substrate materials such as polystyrene or Teflon. The conductive planar element and the conductive planar ground patch are typically made from copper. There can be a layer of gold applied to the outer surface of the copper layers. Alternatively, there can be a layer of solder or a solder mask applied to the top of the copper layer.

In one embodiment of the invention, the conductive planar element is connected to a phase shifter. The phase shifter is independently adjustable to affect the phase of a respective signal transmitted from/to the dipole antenna. Alternatively, or additionally, the planar element can be connected to a delay line and/or a switch. Or the planar element can be connected to a lumped or variable impedance element, with or without the delay line and/or switch. The planar element is also connected to a transmission line which is used to transmit signals to and receive signals from the dipole antenna. Ideally, the peak strength of the directed beam rises no more than about 10° above the horizon.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
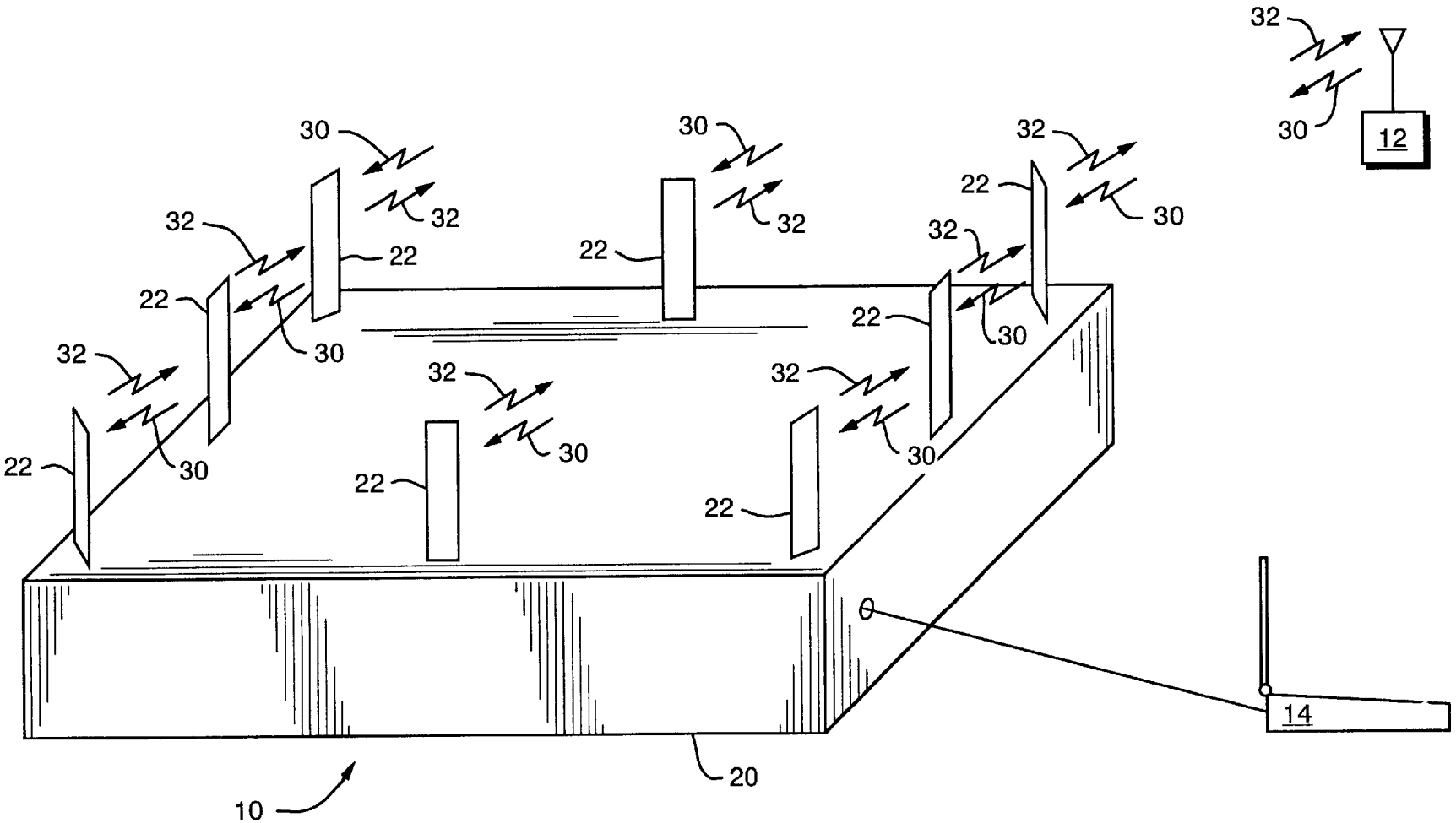
FIG. 1 illustrates a preferred configuration of an antenna apparatus used by a mobile subscriber unit in a cellular system according to this invention.

A description of preferred embodiments of the invention follows. Turning now to the drawings, there is shown in FIG. 1 an antenna apparatus 10 configured according to the present invention. Antenna apparatus 10 serves as the means by which transmission and reception of radio signals is accomplished by a subscriber unit, such as a laptop computer 14 coupled to a wireless cellular modem, with a base station 12. The subscriber unit provides wireless data and/or voice services and can connect devices such as the laptop computer 14, or personal digital assistants (PDAs) or the like through the base station 12 to a network which can be a Public Switched Telephone Network (PSTN), a packet switched computer network, or other data network such as the Internet or a private intranet. The base station 12 may communicate with the network over any number of different efficient communication protocols such as primary ISDN, or even TCP/IP if the network is an Ethernet network such as the Internet. The subscriber unit may be mobile in nature and may travel from one location to another while communicating with base station 12.

It is also to be understood by those skilled in the art that FIG. 1 may be a standard cellular type communication system such as CDMA, TDMA, GSM or other systems in which the radio channels are assigned to carry data and/or voice signals between the base station 12 and the subscriber unit 14. In a preferred embodiment, FIG. 1 is a CDMA-like system, using code division multiplexing principles such as those defined in U.S. Pat. No. 6,151,332.

Antenna apparatus 10 includes a base or ground plane 20 upon which are mounted eight antenna elements 22. As illustrated, the antenna apparatus 10 is coupled to the laptop computer 14 (not drawn to scale). The antenna apparatus 10 allows the laptop computer 14 to perform wireless communications via forward link signals 30 transmitted from the base station 12 and reverse link signals 32 transmitted to the base station 12.

In a preferred embodiment, each antenna element 22 is disposed on the ground plane 20 in the dispersed manner as illustrated in the figure. That is, a preferred embodiment includes four elements which are respectively positioned at locations corresponding to comers of a square, and four additional elements, each being positioned along the sides of the square between respective comer elements.

Figure 2:
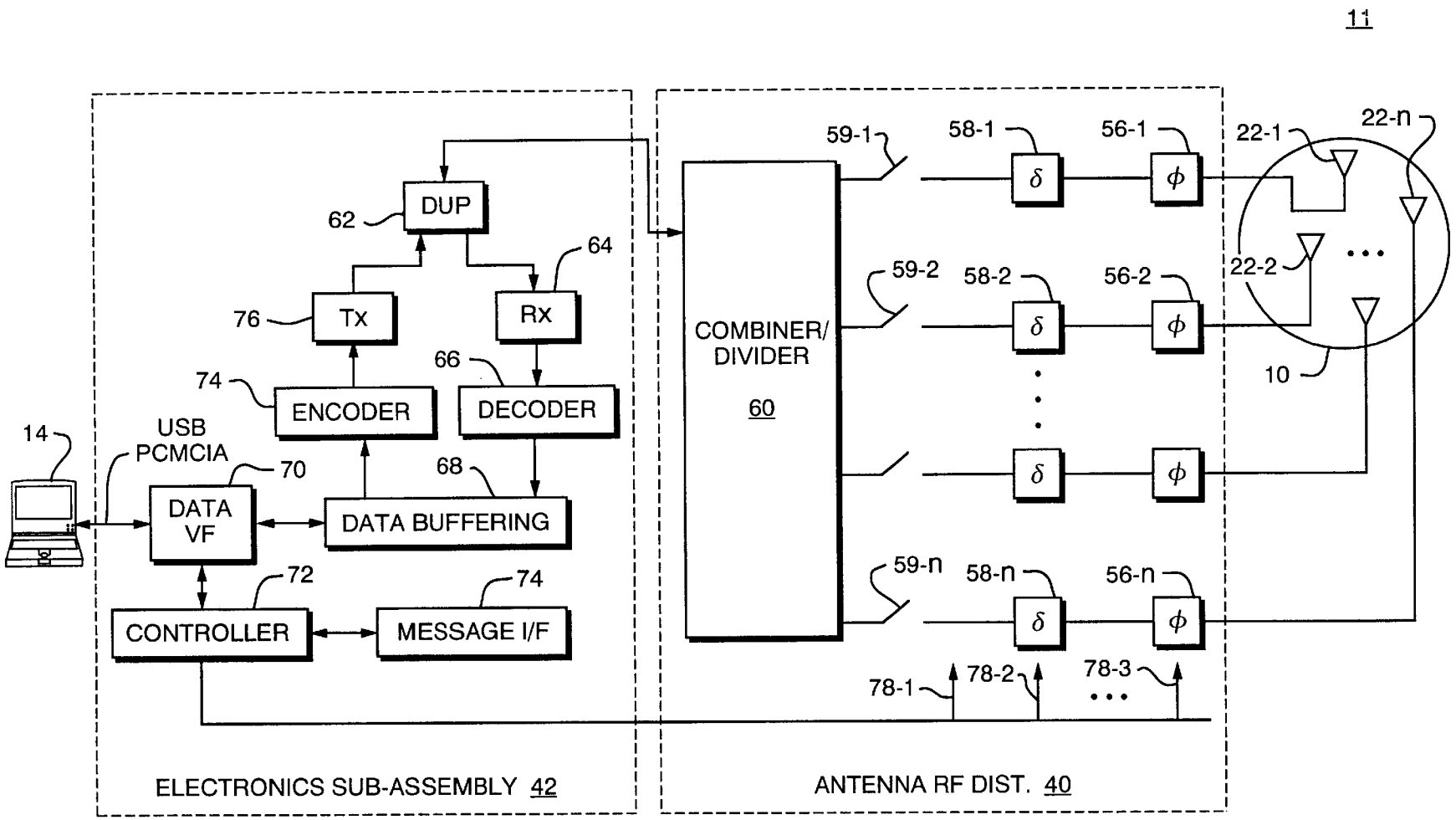
FIG. 2 is a system level diagram for the electronics which control the antenna array.

Turning attention to FIG. 2, there is shown a block diagram of the electronics which control the subscriber access unit 11. The subscriber access unit 11 includes the antenna array 10, antenna Radio Frequency (RF) subassembly 40, and an electronics sub-assembly 42. Wireless signals arriving from the base station 12 are first received at the antenna array 10 which consists of the antenna elements 22-1, 22-2, . . . , 22-N. The signals arriving at each antenna element are fed to the RF subassembly 40, including, for example, a phase shifter (or an:impedance element) 56, delay 58, and/or switch 59. There is an associated phase shifter 56, delay 58, and/or switch 59 associated with each antenna element 22.

The signals are then fed through a combiner divider network 60 which typically adds the energy in each signal chain providing the summed signal to the electronics subassembly 42.

In the transmit direction, radio frequency signals provided by the electronic subassembly 42 are fed to the combiner divider network 60. The signals to be transmitted follow through the signal chain, including the switch 59, delay 58, and/or phase shifter 56 to a respective one of the antenna elements 22, and from there are transmitted back towards the base station.

In the receive direction, the electronics sub-assembly 42 receives the radio signal at the duplexer filter 62 which provides the received signals to the receiver 64. The radio receiver 64 provides a demodulated signal to a decoder circuit 66 that removes the modulation coding. For example, such decoder may operate to remove Code Division Multiple Access (CDMA) type encoding which may involve the use of pseudorandom codes and/or Walsh codes to separate the various signals intended for particular subscriber units, in a manner which is known in the art. The decoded signal is then fed to a data buffering circuit 68 which then feeds the decoded signal to a data interface circuit 70. The interface circuit 70 may then provide the data signals to a typical computer interface such as may be provided by a Universal Serial Bus (USB), PCMCIA type interface, serial interface or other well-known computer interface that is compatible with the laptop computer 14. A controller 72 may receive and/or transmit messages from the data interface to and from a message interface circuit 74 to control the operation of the decoder 66, an encoder 74, the tuning of the transmitter 76 and receiver 64. This may also provide the control signals 78 associated with controlling the state of the switches 59, delays 58, and/or phase shifters 56. For example, a first set of control signals 78-3 may control the phase shifter states such that each individual phase shifter 56 imparts a particular desired phase shift to one of the signals received from or transmitted by the respective antenna element 22. This permits the steering of the entire antenna array 10 to a particular desired direction, thereby increasing the overall available data rate that may be accomplished with the equipment. For example, the access unit 11 may receive a control message from the base station commanded to steer its array to a particular direction and/or circuits associated with the receiver 64 and/or decoder 66 may provide signal strength indication to the controller 72. The controller 72 in turn, periodically sets the values for the phase shifter 56.

Figure 3B:
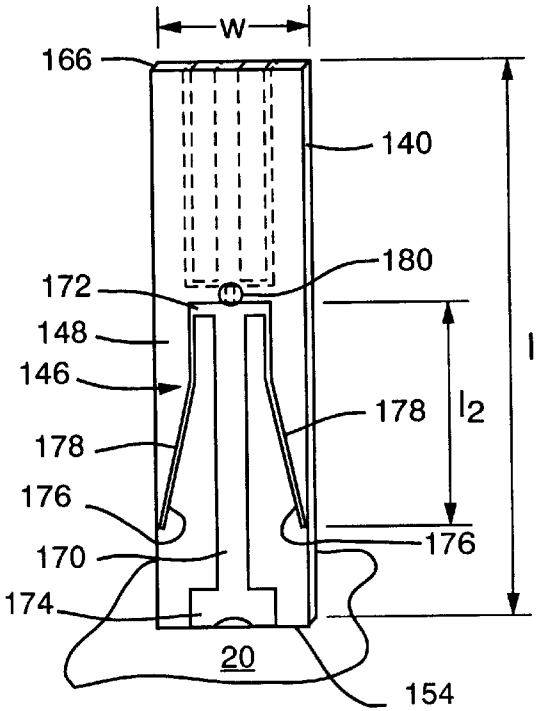
FIG. 3B is a view from the opposite side of the antenna element of FIG. 3A.
Figure 3A:
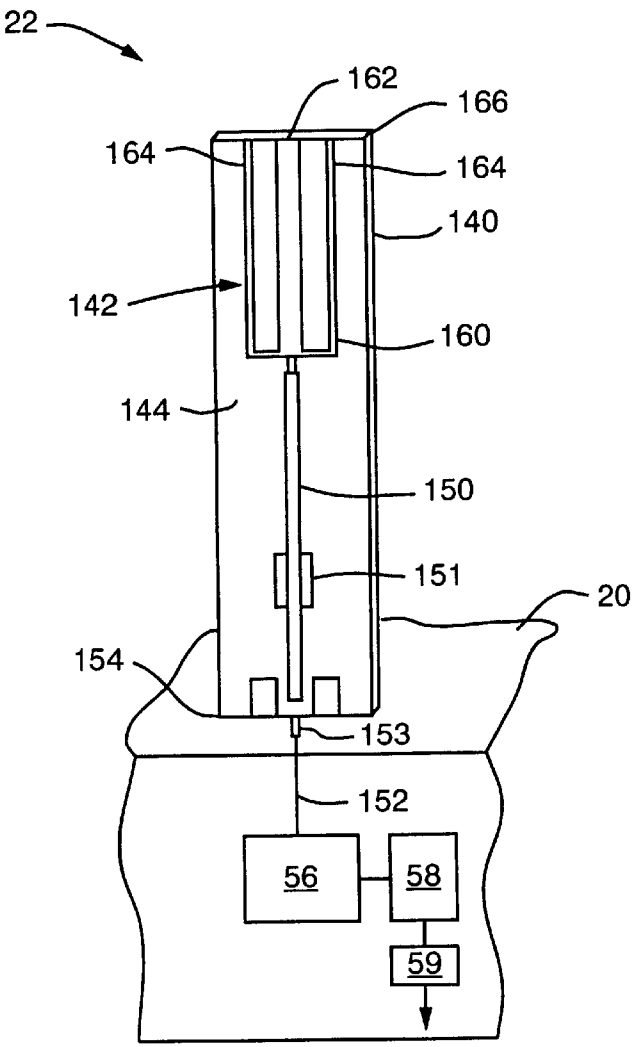
FIG. 3A is a side view of an antenna element of the apparatus of FIG. 1.

Referring now to FIGS. 3A and 3B, each antenna element 22 includes a substrate 140 upon which a conductive planar element 142 is printed on one side 144 in an upper region of the substrate 140 and a conductive planar ground patch 146 is printed on an opposite side 148 in a lower region of the substrate 140. A feed strip 150 extends from the bottom of the conductive planar element and connects to a transmission line 152 at a bottom feed point 153 located at a bottom edge 154 of the substrate 140. The conductive planar element 142 and the transmission line 152 are electrically isolated from the ground plane 20. The feed strip 150 includes an enlarged section 151. The size of enlarged section 151 as well as its location along the feed strip 150 can be varied to alter the impedance of the antenna element 22. Typically, the impedance of the antenna element 22 is matched with the feed impedance.

As mentioned earlier, the antenna element 22, through the transmission line 152 is connected to the phase shifter (or the impedance element) 56 which in turn is connected to the delay line 58 and the switch 59. If the antenna element 22 is connected to an impedance element 56 rather than a phase shifter, the impedance element can be a variable impedance element or a lumped impedance element. The transmission line 152 provides a path for transmitted signals to and received signals from the antenna element 22. The phase shifter 56 of each antenna element 22 is independently adjustable to facilitate changing the phase of a signal transmitted from the antenna element 22.

The conductive planar element 142 includes a base 160 which is aligned perpendicularly to the feed strip 150. Extending upwards from the base 160 are a wider middle arm 162 and two narrower outer arms 164. These arms 162 and 164 extend to a top edge 166 of the substrate 140.

Referring now in particular to FIG. 3B, the conductive planar ground patch 146 includes an elongated middle portion 170 which extends from the midsection of a horizontal strip 172 to an enlarged base 174. (The profile of the conductive planar element 142 is also shown in FIG. 3B for illustrative purposes.) The enlarged base 174 is connected to the ground plane 20 to electrically couple the conductive ground patch 146 to the ground plane 20. Located on either end of the horizontal strip 172 is a downwardly extending arm 176. Each arm 176 includes a flared section 178 which flares away from the elongated middle portion 170.

The substrate 140 is made from a dielectric material. For example, the substrate 140 can be made from, for example, PCB materials such as polystyrene or Teflon. For applications in the PCS bandwidth (1850 Mhz to 1990 Mhz) the substrate has a length, "1," of about 3.035 inches, a width, "w," of about 0.833 inch, and is about 0.031 inch thick. The conductive planar element 142, the feed strip 150, and the conductive planar ground patch 146 are produced with printed circuit board techniques by depositing a respective copper layer to both sides 144 and 148 of the substrate 40 with a thickness of about 0.0015 inch, and then photoetching the copper into the desired shapes. A subsequent thin layer of gold, solder material, or a solder mask, with a thickness of about 0.0001 inch, is layered on top of the copper.

In use, the conductive planar element 142 is fed through feed point 153 along feed strip 150. However, because of capacitive coupling between the conductive planar element 142 and the conductive planar ground patch 46, there is a junction created which provides a distributed feed point 180 in a middle region of the substrate 140. Thus, even though the feed strip 150 does not directly feed the conductive planar ground patch 146, the combination of the conductive planar element 142 and the conductive planar ground patch 146 acts as an unbalanced dipole antenna being fed at the distributed feed point 180. That is, some of the energy provided to the conductive planar element 142 splits off and is fed to the arms 176 of the conductive planar ground patch 146. The sections 178 of the outer arms 176 flare away from the middle elongated portion 170 of the conductive planar ground patch 146 to prevent the resonating arms 176 from interacting or coupling with the middle elongated portion 170 which is coupled to the ground plane 20.

Figure 4:
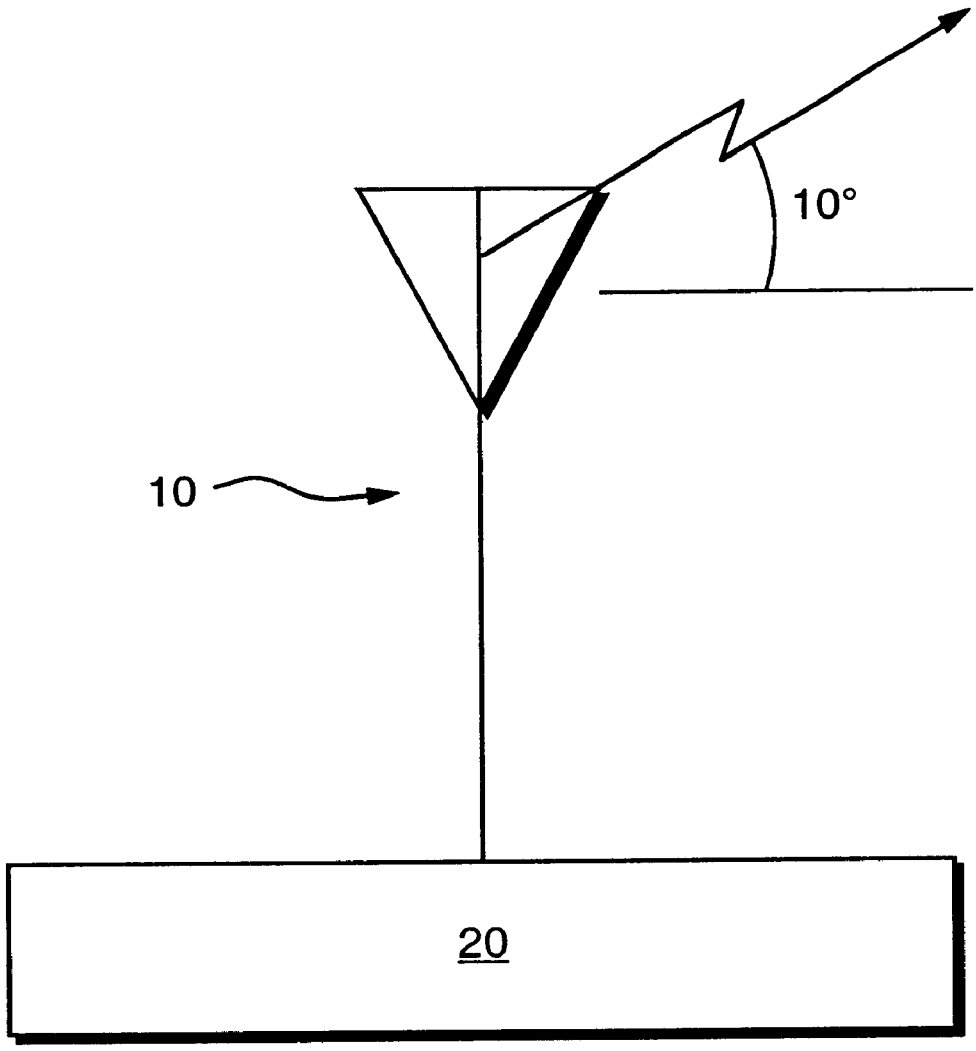
FIG. 4 illustrates a beam directed ten degrees above the horizon by an antenna element configured according to the invention.

Because the conductive planar element 142 is located a distance from the ground plane 20 and is fed by a narrow feed strip 150 which acts as a "choke," interactions between the conductive planar element 142 and the ground plane 20 are minimized. By doing so, the peak beam strength of the beam transmitted by the antenna element 22 is directed more towards the horizon. As illustrated in FIG. 4, the antenna array 10 is capable of forming a beam with a peak beam strength rising no more than 10° above the horizon.

The lengths, "$1_2$," of the arms 176 are equal in length to a quarter wavelength of the transmitted wave. The lengths of these arms 176 as well as the lengths of the arms 162 and 164 of the conductive planar element 142 are trimmed to modify the transmission frequency of the antenna element 22. In PCS applications, the antenna element 22 resonants with a center frequency, "$f_C$," for example of about 1.92

Figure 5A:
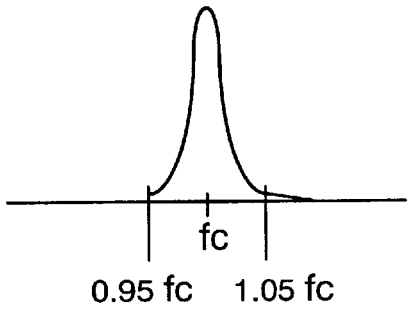
FIG. 5A is a diagram illustrating a narrow bandwidth feature of the antenna element of the present invention.
Figure 5B:
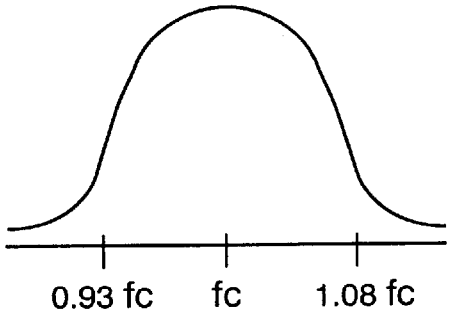
FIG. 5B is a diagram illustrating a broad bandwidth feature of the antenna element of the present invention.
Figure 5C:
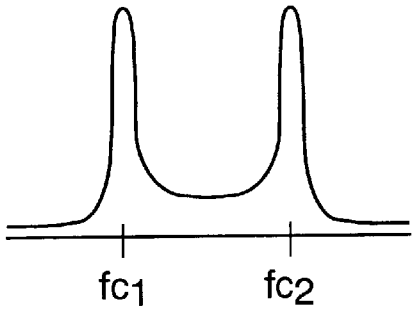
FIG. 5C is a diagram illustrating a multiple bandwidth feature of the antenna element of the present invention.

GHz, with a bandwidth of about 10% (FIG. 5A). Alternatively, the arms 176 of the conductive planar ground patch 146 and the middle arm 162 and the two outer arms 164 of the conductive planar element 142 can have different lengths so that the arms resonant at different frequencies. The different resonating frequencies effectively broaden the bandwidth of the antenna element 22, for example, to about 15% (FIG. 5B), or enable the antenna element 22 to resonant at two, frequencies "$f_{C1}$" and $f_{C2}$" over narrow bandwidths (FIG. 5C), or at more than two frequencies.

While this invention has been particularly shown and described with references to preferred embodiments thereof, it will be understood by those skilled in the art that various changes in form and details: may be made therein without departing from the scope of the invention encompassed by the appended claims.

What is claimed is:

1. A dipole antenna for use in a wireless subscriber unit, comprising:

a planar substrate made of dielectric material;

a conductive planar element disposed on one side of the substrate and located in an upper region of the one side and a feed strip connected thereto and extending from the conductive planar element to a bottom edge of the substrate and terminating at a bottom feed point; and a conductive planar ground patch including a first portion and a second portion disposed on an opposite side of the substrate and positioned in a lower region of the opposite side, the second portion connected to and extending from a midsection of the first portion to the bottom edge of the substrate for facilitating connecting the conductive planar ground patch to a ground plane aligned substantially orthonormal to the substrate;

wherein capacitive coupling between the conductive planar element and the conductive planar ground patch creates a junction which provides an upper dipole feed point in a mid-region of the substrate such that the conductive planar element acts as a first element of an unbalanced dipole antenna and the conductive planar ground patch acts as a second element of the unbalanced dipole antenna to form a beam which may be positionally directed along a horizon that is substantially parallel to the ground plane.

2. The dipole antenna of claim 1, wherein the conductive planar element includes a base aligned along an axis that is substantially parallel to a top edge of the substrate, a middle arm connected to a midsection of the base, the middle arm being aligned along an axis that is perpendicular to the base and extending towards the top edge of the substrate, a first outer arm connected to a first outer section of the base, and a second outer arm connected to a second outer section of the base distal to the first outer section, each of the outer arms being aligned along a respective axis that is perpendicular to the base and extending towards the top edge of the substrate.

3. The dipole antenna of claim 2, wherein the feed strip connects to the midsection of the base and includes an enlarged section, the size and location of the enlarged section being altered to match the impedance of the dipole antenna with the feed impedance.

4. The dipole antenna of claim 2, wherein the lengths of the arms are varied to change the transmission, frequency of the dipole antenna.

5. The dipole antenna of claim 2, wherein the first portion of the conductive planar ground patch includes a top strip positioned in an upper area of the lower region of the opposite side and aligned along an axis that is substantially parallel to the bottom edge of the substrate, a first outer arm connected to a first end of the upper strip, and a second outer arm connected to a second end, distal from the first end, of the upper strip, the outer arms extending from the respective ends of the upper strip towards the bottom edge of the substrate, the second portion of the conductive planar ground patch being a middle strip aligned along an axis that is substantially perpendicular to the bottom edge.

6. The dipole antenna of claim 5, wherein each of the first outer arm and the second outer arm includes a section which flares away from the middle strip.

7. The dipole antenna of claim 6, wherein the length of the first outer arm and the length of the second outer arm are approximately equal in length to a quarter wavelength of the beam transmitted from and received by the dipole antenna.

8. The dipole antenna of claim 6, wherein the lengths of the outer arms are varied to change the transmission frequency of the dipole antenna.

9. The dipole antenna of claim 6, wherein the length of the first outer arm and the length of the second outer arm of the conductive planar element and the length of the first outer arm and the length of the second outer arm of the conductive planar ground patch are staggered to widen the bandwidth of the dipole antenna.

10. The dipole antenna of claim 1, wherein the dielectric material is a printed circuit board (PCB) material.

11. The dipole antenna of claim 1, wherein the dielectric material is made of polystyrene.

12. The dipole antenna of claim 1, wherein the dielectric material is made of Teflon.

13. The dipole antenna of claim 1, wherein the conductive planar element and the conductive planar ground patch are made of copper.

14. The dipole antenna of claim 13, wherein gold is layered over the top surfaces of the copper layers.

15. The dipole antenna of claim 13, wherein solder material is layered over the top surfaces of the copper layers.

16. The dipole antenna of claim 13, wherein a solder mask is layered over the top surfaces of the copper layers.

17. The dipole antenna of claim 1, wherein the conductive planar element is connected to a phase shifter, the phase shifter being independently adjustable to affect the phase of a respective signal transmitted from the dipole antenna.

18. The dipole antenna of claim 1, wherein the conductive planar element is connected to a delay line.

19. The dipole antenna of claim 1, wherein the conductive planar element is connected to a lumped impedance element.

20. The dipole antenna of claim 1, wherein the conductive planar element is connected to a variable impedance element.

21. The dipole antenna of claim 1, wherein the conductive planar element is connected to a switch.

22. The dipole antenna of claim 1, wherein the conductive planar element is connected to a phase shifter, a delay line, and a switch.

23. The dipole antenna of claim 1, wherein the bottom feed point is connected to a transmission line for transmitting signals to and receiving signals from the dipole antenna.

24. The dipole antenna of claim 1, wherein the directed beam rises above the horizon at an angle of about 10°.

25. The dipole antenna of claim 1, wherein the antenna is capable of operating with a bandwidth of about 10%.

26. The dipole antenna of claim 1, wherein the antenna is capable of operating with a bandwidth of about 15%.

27. The dipole antenna of claim 1, wherein the antenna is capable of operating with at least two frequencies.

* * * * *